US008752335B2

(12) United States Patent
Hoffmann

(10) Patent No.: US 8,752,335 B2
(45) Date of Patent: Jun. 17, 2014

(54) BULB SEALS FOR DOORS

(75) Inventor: David J. Hoffmann, Peosta, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 13/431,601

(22) Filed: Mar. 27, 2012

(65) Prior Publication Data

US 2013/0255159 A1 Oct. 3, 2013

(51) Int. Cl.
*E06B 7/22* (2006.01)

(52) U.S. Cl.
USPC ..... 49/499.1; 49/462

(58) Field of Classification Search
USPC ..... 49/475.1, 462, 500.1, 498.1, 499.1, 49/460, 383, 384, 197, 469, 470
See application file for complete search history.

(56) References Cited

U.S. PATENT DOCUMENTS

| | | | | |
|---|---|---|---|---|
| 712,240 | A | 10/1902 | Barnes et al. | |
| 1,337,394 | A | 4/1920 | Dillingham | |
| 1,452,703 | A | 4/1923 | Pollard | |
| 1,704,048 | A * | 3/1929 | Jordan | 280/847 |
| 1,958,131 | A * | 5/1934 | Davidson | 156/79 |
| 2,012,625 | A * | 8/1935 | Calcutt | 49/475.1 |
| 2,121,826 | A * | 6/1938 | Roberts | 49/498.1 |
| 2,133,199 | A * | 10/1938 | Kammerer | 49/493.1 |
| 2,686,943 | A * | 8/1954 | Kunkel | 49/493.1 |
| 3,384,996 | A * | 5/1968 | Gilchrist et al. | 49/383 |
| 3,462,885 | A * | 8/1969 | Miller | 49/475.1 |
| 3,755,968 | A * | 9/1973 | Williams | 49/489.1 |
| 3,854,246 | A * | 12/1974 | McAllister | 49/470 |
| 3,854,257 | A | 12/1974 | Lobel | |
| 4,520,594 | A * | 6/1985 | Adell | 49/462 |
| 4,691,478 | A * | 9/1987 | Lorg | 49/499.1 |
| 5,927,018 | A * | 7/1999 | Thain | 49/460 |

(Continued)

FOREIGN PATENT DOCUMENTS

| | | | | |
|---|---|---|---|---|
| EP | 503908 A1 * | 9/1992 | | E06B 3/02 |
| EP | 2202381 A2 | 6/2010 | | |

(Continued)

OTHER PUBLICATIONS

International Searching Authority, "International Search Report" issued in connection with PCT Patent Application No. PCT/US2013/033684, mailed on Sep. 6, 2013, 8 pages.

(Continued)

*Primary Examiner* — Jerry Redman
(74) *Attorney, Agent, or Firm* — Hanley, Flight & Zimmerman, LLC.

(57) ABSTRACT

Example doors having a seal attached to an edge member of a door panel are disclosed herein. An example seal includes a flexible sheet of material with its longitudinal edges turned inward toward a more central portion of the sheet such that the sheet is turned partially or somewhat inside-out to provide a bulging seal geometry that is favorable for sealing in multiple directions. The seal, for example, is suitable for sealing in a head-on direction engaging an abutting surface, such as a doorjamb. The seal can also seal in sliding engagement with an adjacent surface parallel to the door panel. In some examples, the sheet defines a hollow chamber in which the longitudinal edges of the sheet reinforce or brace an exterior curved portion of the seal. In some examples, the sheet of material is a unitary seamless piece with an attached touch-and-hold fastener that makes the seal readily replaceable.

33 Claims, 10 Drawing Sheets

(56) References Cited

U.S. PATENT DOCUMENTS

| | | | | |
|---|---|---|---|---|
| 6,061,967 | A * | 5/2000 | Judds | 49/469 |
| 7,861,465 | B1 * | 1/2011 | Christ et al. | 49/506 |
| 2001/0049909 | A1 * | 12/2001 | Homolka et al. | 49/460 |
| 2005/0086868 | A1 | 4/2005 | Santelli, Jr. | |
| 2005/0252084 | A1 * | 11/2005 | Antoshak | 49/70 |

FOREIGN PATENT DOCUMENTS

| | | | | |
|---|---|---|---|---|
| FR | 2324849 | A1 | 4/1977 | |
| GB | 1079667 | A | 8/1967 | |
| GB | 1267733 | A | 3/1972 | |
| GB | 2107771 | A | 5/1983 | |
| GB | 2268533 | A * | 1/1994 | E06B 3/88 |
| GB | 2294282 | A | 4/1996 | |
| WO | 8102604 | A1 | 9/1981 | |
| WO | 2011100816 | A1 | 8/2011 | |

OTHER PUBLICATIONS

International Searching Authority, "Written Opinion of the International Searching Authority," issued in connection with PCT Patent Application No. PCT/US2013/033684, mailed on Sep. 6, 2013, 14 pages.

* cited by examiner

BULB SEALS FOR DOORS

FIELD OF THE DISCLOSURE

This patent generally pertains to doors and, more specifically, to bulb seals for doors.

BACKGROUND

Doors and movable room dividers typically comprise one or more flexible, rigid or articulated panels that pivot, translate or otherwise move between open and closed positions. Some panels have a flexible seal along a relatively rigid leading edge, and/or along other edges, to ensure sealing engagement with a doorjamb, floor, wall or another panel. Example doors, room dividers and panels include rollup doors, vertically moving door panels, laterally translating door panels, translating wall panels, articulated doors having a series of pivotally interconnected panels (e.g., common residential garage door), and concertina doors.

DETAILED DESCRIPTION

Figure 1:
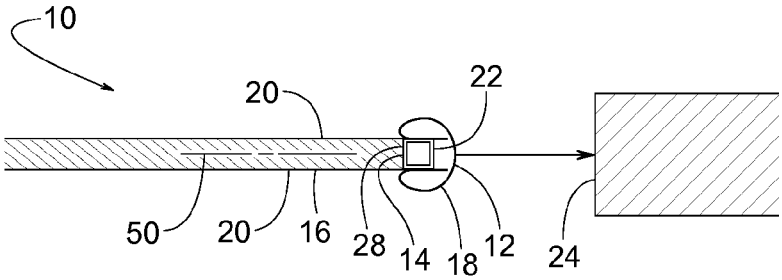
FIG. 1 is a cross-sectional view taken along line 1-1 of FIG. 2.
Figure 2:
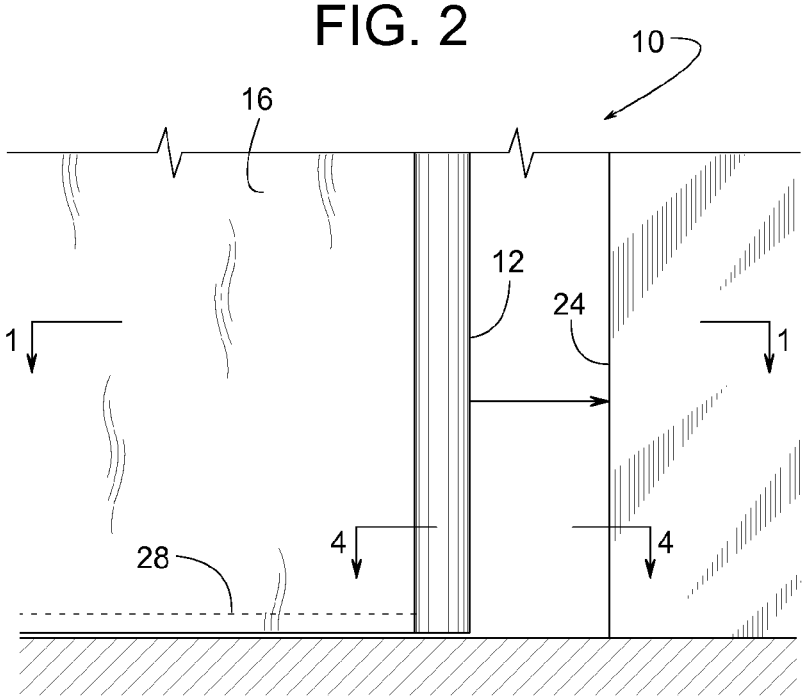
FIG. 2 is a front view of an example door constructed in accordance with the teachings of this disclosure.
Figure 3:
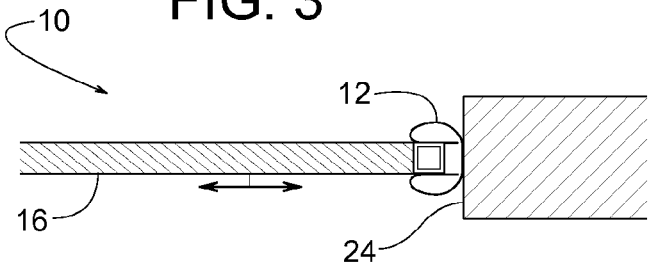
FIG. 3 is a cross-sectional view similar to FIG. 1, but showing the example door in a closed position.

Example seal apparatus disclosed herein include a flexible sheet of material having its longitudinal edges turned inward toward a more central portion of the sheet such that the sheet is turned partially or somewhat inside-out to provide a bulging seal geometry that is favorable for sealing in multiple directions. The example seal, for example, is suitable for sealing in a head-on direction engaging an abutting surface, such as a doorjamb. The example seal can also seal in sliding engagement with an adjacent surface parallel to a door panel. In some examples, the sheet defines a hollow chamber in which the longitudinal edges of the sheet reinforce or brace an exterior curved portion of the seal. In some examples, the sheet of material is a unitary seamless piece with an attached touch-and-hold fastener that makes the seal readily replaceable.

In FIGS. 1-8 show an example door apparatus 10 having a seal 12 coupled or attached to an edge member 14 of a door panel 16. Examples of edge member 14 include, but are not limited to, a leading edge member, a trailing edge member, an upper edge member, a lower edge member, and a lateral edge member. The term, "door panel" as used herein is defined to mean any member movable across an opening such as, for example, across a doorway or across a space between adjoining areas of a room. In the latter example where a door panel can divide a room into two smaller room areas, such a door panel is also known as a "wall panel." Thus, the terms, "door panel" and "wall panel" are used interchangeably. The term, "door apparatus" as used herein is defined to include any structure including such a door panel or wall panel. In some examples, seal 12 is made of a flexible single sheet of material 18 (FIGS. 6A, 6B and 6C) formed and/or attached to door panel 16 so as to create a bulge or a bubble-like seal on each side 20 of door panel 16 and on the door panel's leading edge 22. For example, the seal 12 bulges along an arcuate path between a first side (e.g., a front side) of the door panel 16 and a second side (e.g., a rear side) of the door panel 16 and surrounds the leading edge 14 of the door panel 16. As a result, the seal 12 provides a plurality of sealing surfaces lying tangentially along a respective plurality of imaginary planes. For example, the seal 12 provides sealing areas in multiple directions such as, for example, a first sealing area 12*a* adjacent a first side of the door panel 16, a second sealing area 12*b* adjacent a second side of the door panel 16, and a third sealing area 12*c* adjacent the edge member 14 of the door panel 16. In other words, the seal 12 can provide a first sealing surface in a first direction and a second sealing surface in at least another direction that is non-parallel (e.g., substantially perpendicular) relative to the first direction.

Figure 7:
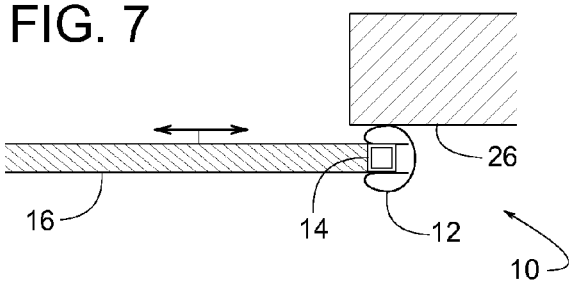
FIG. 7 is a cross-sectional view similar to FIG. 3, but showing the example door in another example sealing configuration.
Figure 8:
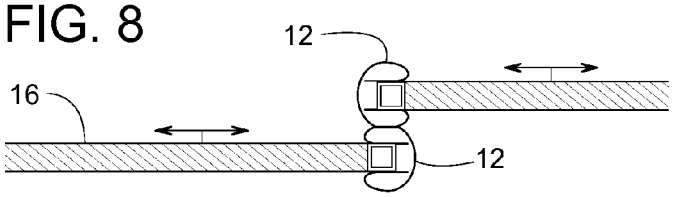
FIG. 8 is a cross-sectional view similar to FIGS. 3 and 7, but showing yet another example sealing configuration.

The seal 12 of the illustrated example is suitable for various door configurations. FIGS. 1-5, for example, show seal 12 provides an abutting seal engagement between panel 16 and an abutting surface 24 (e.g., a floor, a wall, a doorjamb, the leading edge of another door panel, etc.). The examples of FIGS. 7 and 8 show sliding seal engagement between seal 12 and an adjacent surface 26, such as a wall (FIG. 7), another door panel, and/or a seal of another door panel (FIG. 8).

Although the construction of door panel 16 and seal 12 may vary, some examples of door panel 16 comprise a relatively rigid frame 28 including edge member 14. In some examples, frame 28 and its edge member 14 are made of tubing (e.g., metal square tubing). The sides and interior of door panel 16, in some examples, comprise insulation positioned or sandwiched between two flexible sheets of material attached to frame 28. Some examples of door panel 16 have generally rigid and/or solid sides. Other examples of door panel 16 include, but are not limited to, rollup door panels having a relatively rigid leading edge, panels of concertina doors, laterally sliding door panels, laterally sliding wall panels, vertically moving door panels, segments of an articulated door panel comprising a series of segments interconnected by hinges, solid door panels, hollow door panels, insulated door panels, and uninsulated door panels.

To provide effective sealing, the sheet of material 18, in some examples, has relatively greater flexibility than the flexibility of edge member 14. Examples of sheet material 18 include, but are not limited to, chlorosulfonated polyethylene synthetic rubber or CSM or CSPE (also known as HYPALON, which is a registered trademark of DuPont of Wilmington, Del.), canvas duck, rubber-impregnated fabric, coated nylon or polyester fabric, 40-ounce vinyl fabric, vinyl fabric of other weights, other fabric materials, neoprene sheeting, vinyl sheeting, other flexible polymeric sheeting, etc. Some examples of sheet 18 are a seamless unitary piece (e.g., monolithic, homogeneous, etc.) to which a fastener or a reinforcement layer can be attached.

Figure 4:
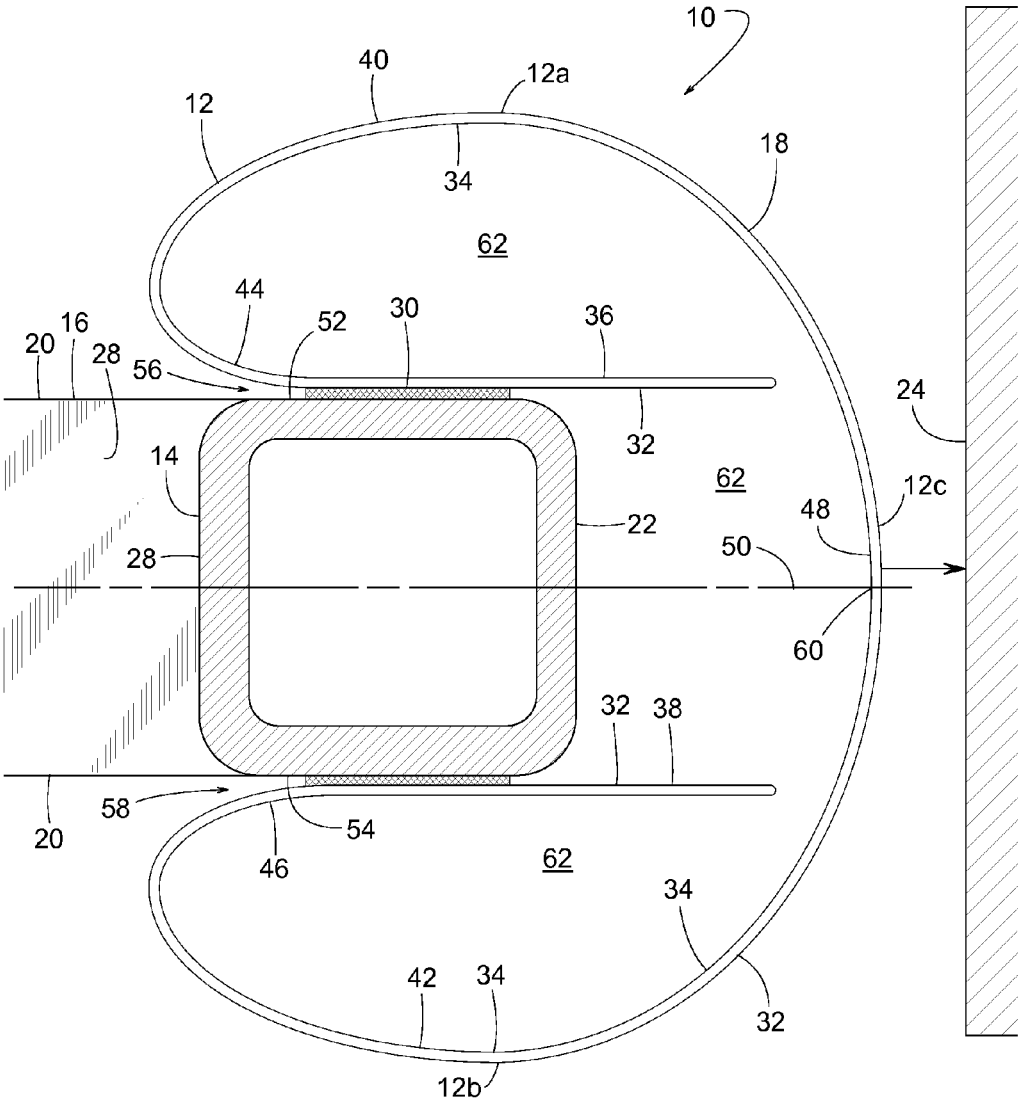
FIG. 4 is a cross-sectional view taken generally along line 4-4 of FIG. 2.
Figure 9:
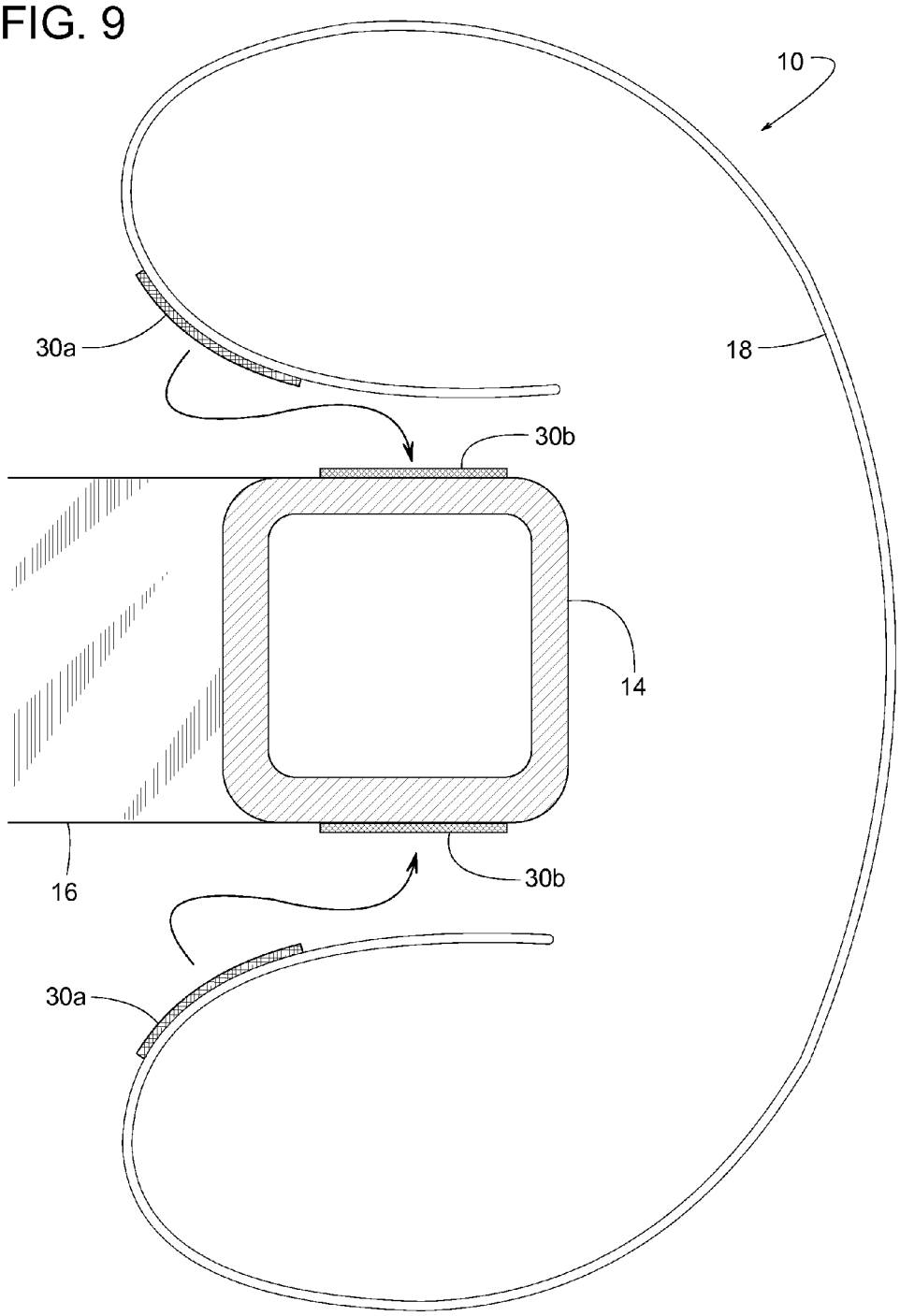
FIG. 9 is a cross-sectional view similar to FIG. 4, but showing the seal being installed.

In some examples, sheet 18 is formed, positioned, configured, adapted and/or shaped as shown in FIG. 4 and is attached to edge member 14 by way of a suitable fastener. Examples of such a fastener include, but are not limited to, a touch-and-hold fastener 30 (e.g., VELCRO, which is a registered trademark of Velcro Industries of Manchester, N.H.), tongue-in-groove connection, buttons, snaps, adhesive, double-sided adhesive tape, and/or a welded interface. By way of example shown in FIG. 9, touch-and-hold fastener 30 (comprising parts 30*a* and 30*b*) attaches sheet 18 to edge member 14. In some examples, touch-and-hold fastener part 30*a* or 30*b* is sewn to sheet 18. In other examples, an adhesive attaches or bonds part 30*a* or 30*b* to sheet 18. Attaching sheet 18 to edge member 14 as shown in FIG. 9 enables the seal to be installed and/or replaced without having to slide seal 12 lengthwise along the door panel's edge 22. Having to slide a seal lengthwise along a door's leading edge might require having to temporarily remove the door panel, which could be difficult, time consuming or expensive.

Figure 5:
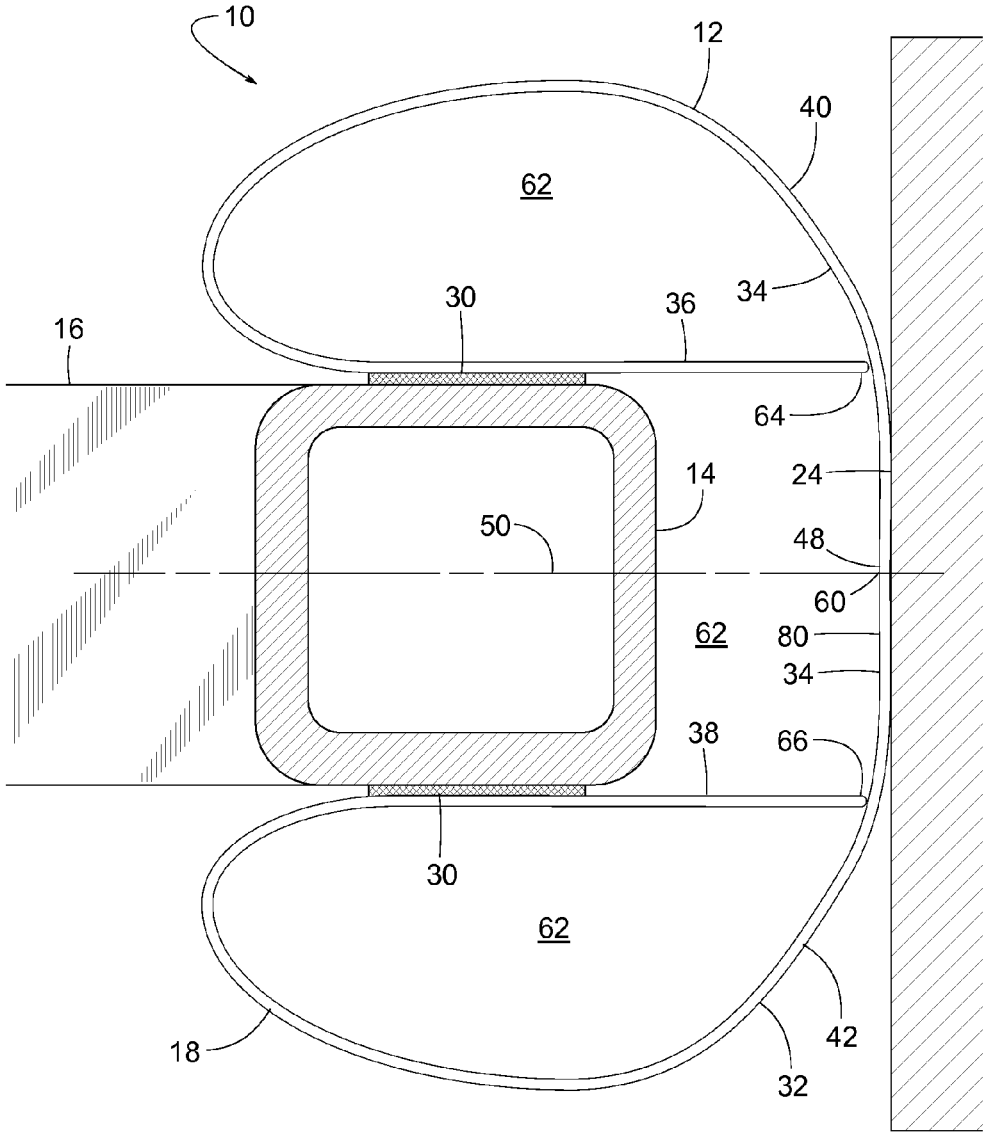
FIG. 5 is a cross-sectional view similar to FIG. 4, but showing the example door in the closed position.
Figure 6A:
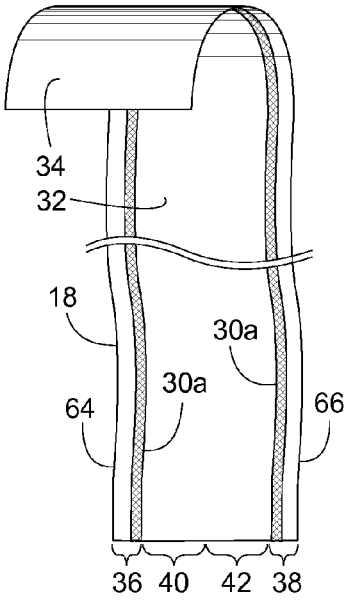
FIG. 6A is a perspective view of an example sheet material of the door of FIG. 1.
Figure 6B:
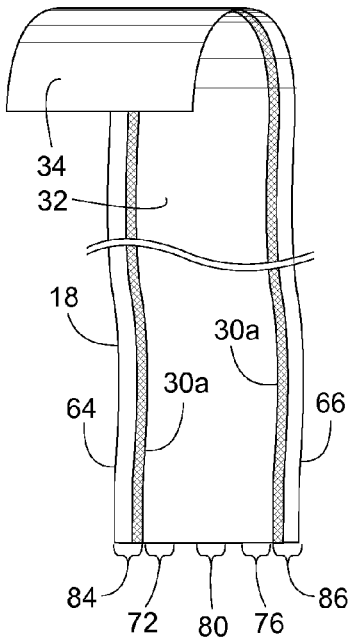
FIG. 6B is a perspective view similar to FIG. 6A, but showing different portions of the example sheet material when the example sheet material is configured as shown in FIG. 12.
Figure 6C:
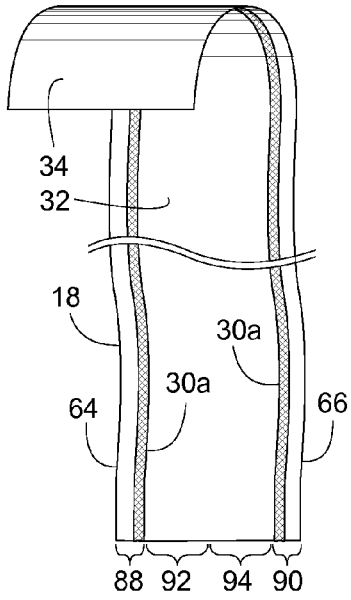
FIG. 6C is a perspective view similar to FIGS. 6A and 6B, but showing different portions of the example sheet material when the example sheet material is configured as shown in FIG. 13.

Once the seal 12 is installed to the door panel 16, sheet 18 forms, defines or assumes a geometry, shape or configuration as shown, for example, in FIGS. 4 and 5. For instance, when the seal 12 forms a shape as shown in FIGS. 4 and 5, sheet 18 of seal 12 comprises a front side 32 and back side 34 both of which extend across a first section 36, a second section 38, a third section 40 and a fourth section 42 of sheet of material 18. Front side 32 of first section 36 is oriented or faces toward front side 32 of second section 38 and back side 34 of third section 40 is oriented or faces toward back side 34 of the fourth section 42. In some examples, first section 36 adjoins third section 40 at a first transition 44, second section 38 adjoins fourth section 42 at a second transition 46, and third section 40 adjoins fourth section 42 at a third transition 48. Transitions 44, 46 and 48 are locations or positions along the sheet 18 where one section 36, 38, 40 and 42 ends and another one of the sections 36, 38, 40 and 42 begins, including examples where two adjoining sections (e.g., 40 and 42) extend integrally from each other without any discrete coupling, joint or seam between them.

In some examples, door panel 16 extends along an imaginary plane 50 lying between a first side surface 52 and a second side surface 54 of edge member 14. First side surface 52 and second side surface 54 face away from each other and provide respective first and second areas of attachment 56 and 58 for attaching sheet 18 to edge member 14 such that first transition 44 is adjacent to first side surface 52, second transition 46 is adjacent to second side surface 54 and a portion of the third transition 48 intersects or is on imaginary plane 50. The term, "adjacent," as used herein and throughout this patent means significantly close and not necessarily in direct contact.

In the illustrated examples, first side surface 52 of edge member 14 is closer to front side 32 than back side 34 of sheet 18, and edge member 14 is closer to back side 34 than to front side 32 at third transition 48, wherein third transition 48 is at an intersection 60 of sheet 18 and plane 50. Also, back side 34 at intersection 60 faces edge member 14, and front side 32 at the first and second areas of attachment 56 and 58 face toward the edge member's first and second side surfaces 52 and 54. In other words, respective distal ends of sheet 18 are folded, curled or curved to be positioned toward the transition portion 48. Thus, the seal 12 has a C-shaped transverse cross-sectional shape.

Figure 10:
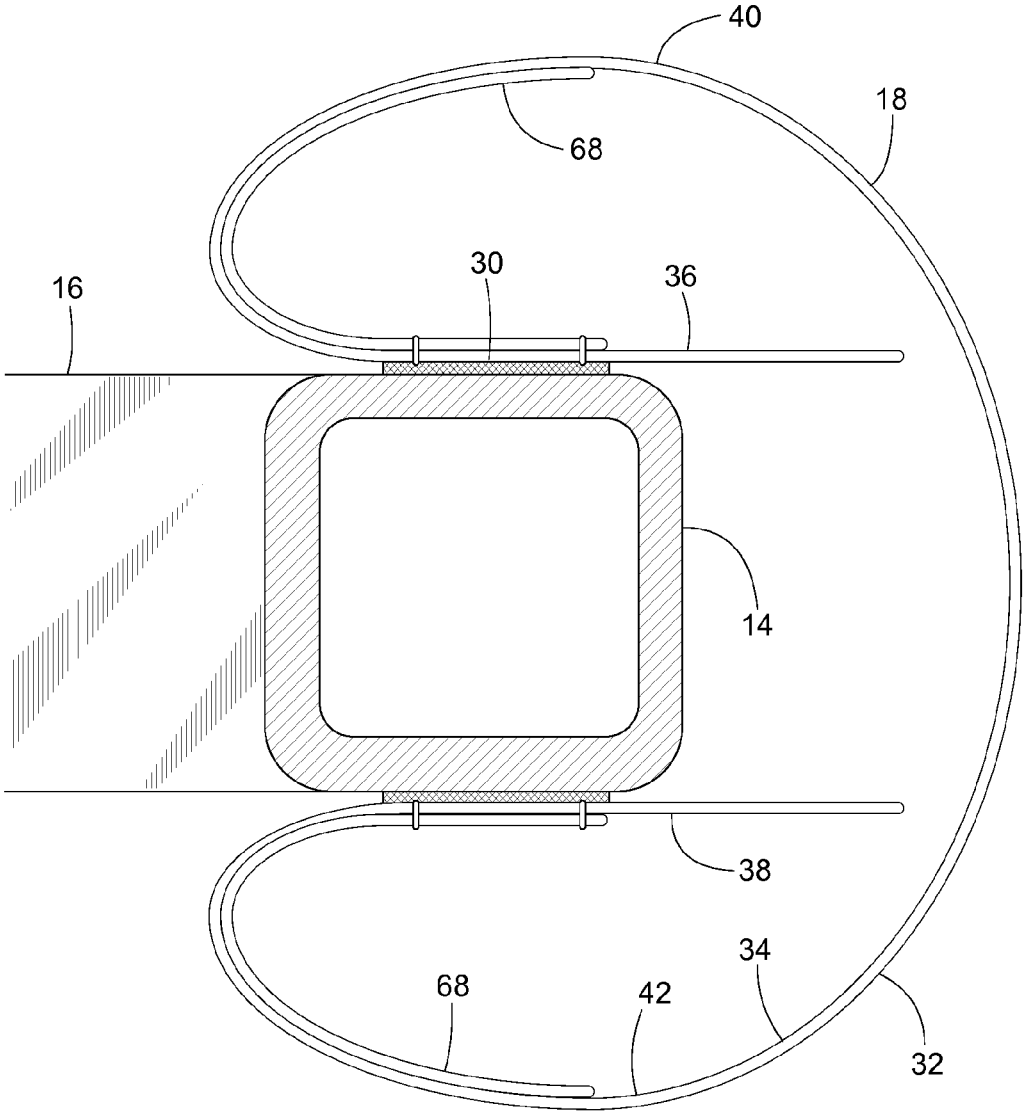
FIG. 10 is a cross-sectional view similar to FIG. 4, but showing another example door disclosed herein.
Figure 11:
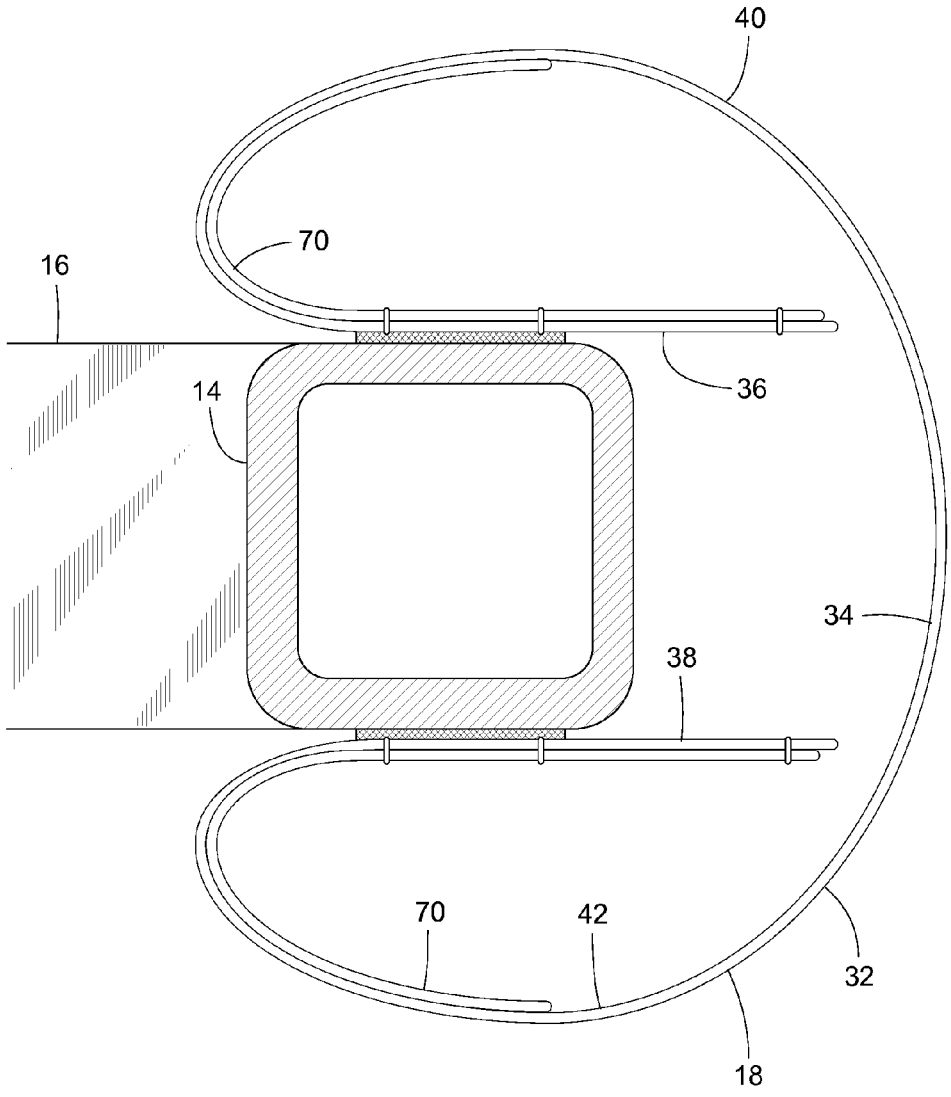
FIG. 11 is a cross-sectional view similar to FIG. 10, but showing yet another example door disclosed herein.

To provide sheet 18 with added support near third transition 48, third section 40 and the fourth section 42 define a chamber 62 therebetween, and first section 36 and second section 38 extend into chamber 62 such that when seal 12 engages abutting surface 24, as shown in FIG. 5, two distal edges 64 and 66 of first and second sections 36 and 38 engage back side 34 of third and fourth sections 40 and 42. To stiffen or reinforce sheet 18 between sections 36 and 40 and between sections 38 and 42, one or more reinforcement layers, such as a layer 68 in FIG. 10 or a layer 70 in FIG. 11, can be sewn or otherwise attached to back side 34 of sheet 18. Additionally or alternatively, one or more reinforcement layers can be attached to the front side 32 of sheet 18. In some examples, the reinforcement layers are composed of the same material as sheet 18, and in other examples, the reinforcement layers are composed of a different material.

Figure 12:
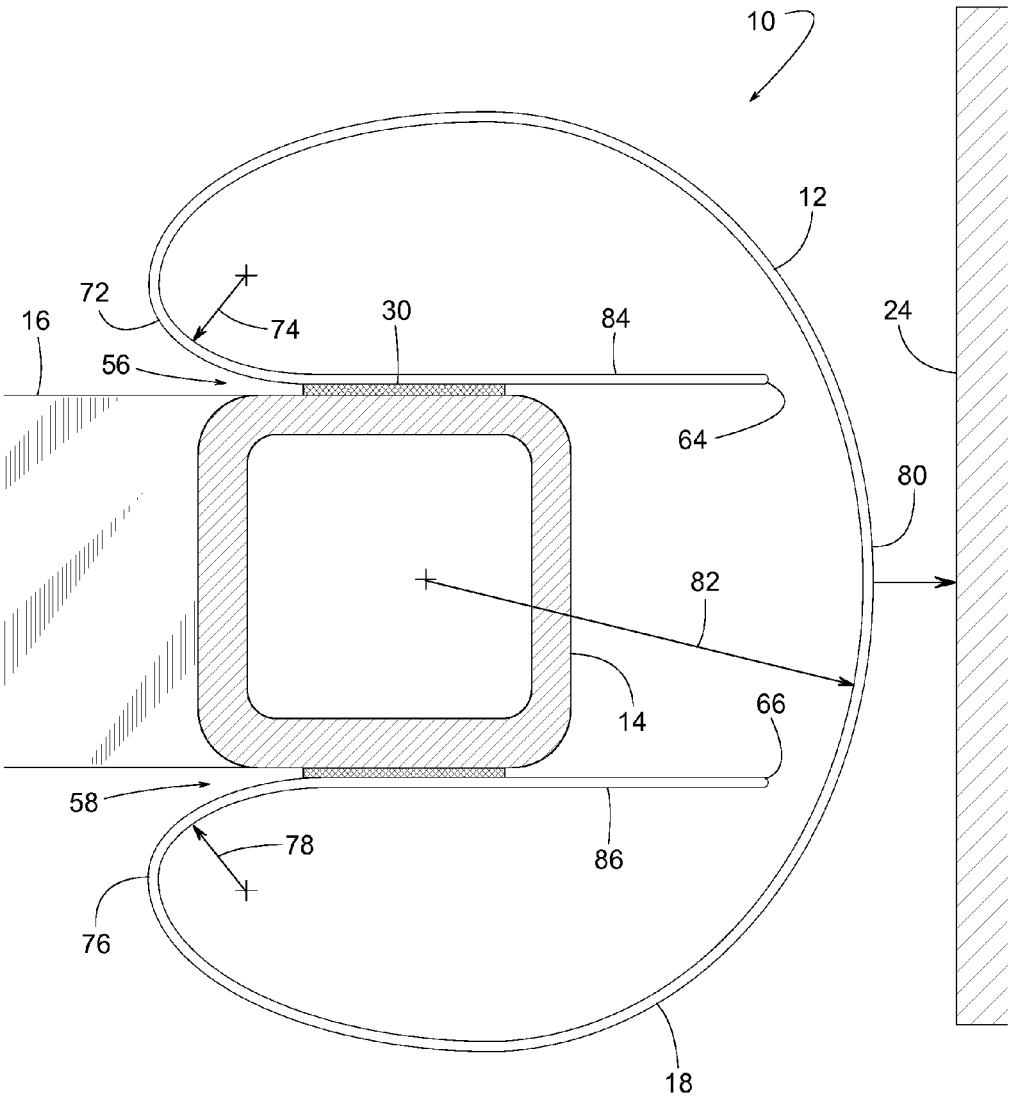
FIG. 12 is a cross-sectional view virtually identical to FIG. 4, but showing the example sheet material in a different configuration.

In some examples, the sheet 18 is configured, shaped or formed as shown in FIG. 12. FIG. 12 is virtually identical to FIG. 4; however, FIG. 12 references additional or other features of door apparatus 10. The example seal 12 of FIG. 12 has a first portion 72 having a first radius of curvature 74, a second portion 76 having a second radius of curvature 78, and a third portion 80 having a third radius of curvature 82, wherein the first radius of curvature 74 and second radius of curvature 78 are smaller than third radius of curvature 82, and edge member 14 is closer to the first and second portions 72 and 76 than to third portion 80.

In some examples, sheet 18 includes a first distal edge portion 84 and a second distal edge portion 86, wherein first distal edge portion 84 extends between first area of attachment 56 and first distal edge 64, and second distal edge portion 86 extends between second area of attachment 58 and second distal edge 66. First area of attachment 56 is between first portion 72 and first distal edge 64 and second area of attachment 58 is between second portion 76 and second distal edge 66. In such an example, first distal edge portion 84 and second distal edge portion 86 are flatter than first portion 72 and second portion 76, as shown in FIG. 12. As shown in FIG. 5, distal edges 64 and 66 engage the third portion 80 of the sheet 18 when seal 12 is forced against abutting surface 24.

Figure 13:
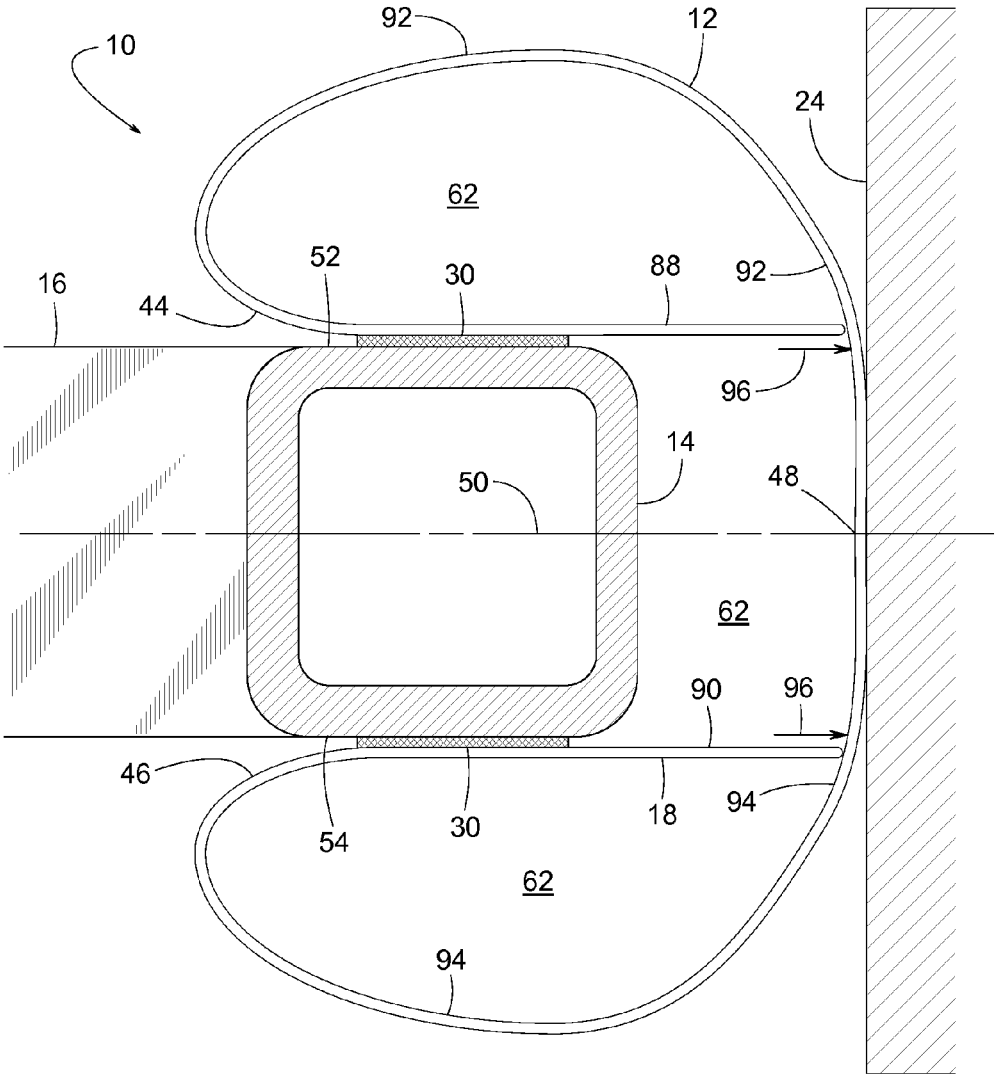
FIG. 13 is a cross-sectional view virtually identical to FIG. 5, but showing the example sheet material in a different configuration.

In the illustrated example of FIG. 13, sheet 18 has another example geometrical shape, form and/or configuration. FIG. 13 is virtually identical to FIG. 5; however, FIG. 13 references additional or other features of door apparatus 10. FIG. 13 shows seal 12 comprising a first internal sheet segment 88, a second internal sheet segment 90, a first external sheet segment 92 and a second external sheet segment 94, wherein sheet segments 88, 90, 92 and 94 are integral with each other to render seal 12 as a unitary sheet of material that is more flexible than edge member 14. First internal sheet segment 88 is connected to first side surface 52 of edge member 14, and second internal sheet segment 90 is connected to second side surface 54 of edge member 14. First and second internal sheet segments 88 and 90 each are substantially planar relative to (e.g., substantially flatter than) first and second external sheet segments 92 and 94. First and second external sheet segments 92 and 94 define chamber 62, and first and second internal sheet segments 88 and 90 extend into chamber 62. When seal 12 is forced against abutting surface 24, first and second internal sheet segments 88 and 90 exert a force 96 generally parallel to plane 50, where force 96 is transmitted to first and second external sheet segments 92 and 94.

In the example shown in FIG. 13, first internal sheet segment 88 is positioned between first external sheet segment 92 and first side surface 52 of edge member 14, and second internal sheet segment 90 is positioned between second external sheet segment 94 and second side surface 54 of edge member 14. FIG. 13 also shows first transition 44 positioned between first internal sheet segment 88 and first external sheet segment 92, second transition 46 positioned between second internal sheet segment 90 and second external sheet segment 94, and third transition 48 positioned between first external sheet segment 92 and second external sheet segment 94. In the illustrated example of FIG. 13, first transition 44 is adjacent first side surface 52, second transition 46 is adjacent second side surface 54, and third transition 48 is on plane 50.

Figure 14:
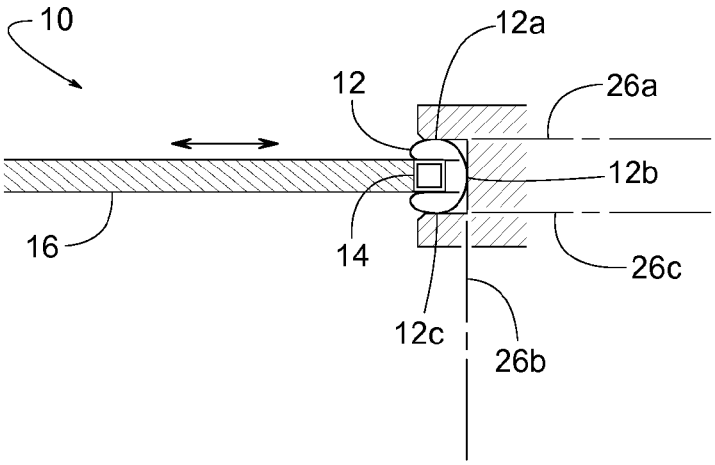
FIG. 14 is a cross-sectional view similar to FIG. 3, but showing another example door in use.
Figure 15:
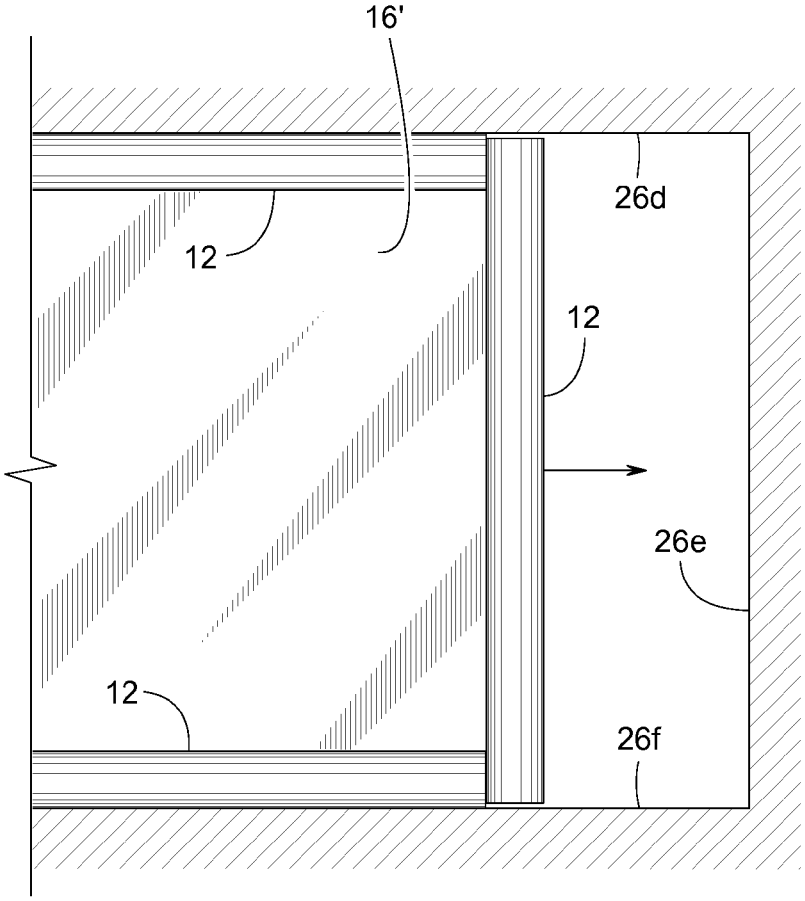
FIG. 15 is a front view similar to FIG. 2, but showing another example door.

FIG. 14 shows an example seal 12 having a plurality of sealing surfaces such as, for example, three surfaces 12*a*, 12*b* and 12*c* sealing against three adjacent surfaces lying along three imaginary planes 26*a*, 26*b* and 26*c*, respectively. FIG. 15 shows an example door panel 16' (door panel or wall panel) having a plurality of seals 12 such as, for example, three seals 12 substantially similar or identical in shape for sealing against three adjacent surfaces 26*d*, 26*e* and 26*f* of a door way.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A door comprising:

a door panel having an edge; and a seal attached to the edge, the seal comprising a sheet of material that is more flexible than the edge, the sheet of material comprising a front side and a back side both of which extend across a first section, a second section, a third section and a fourth section of the sheet of material, the first and second sections extending beyond the edge of the door panel, the front side of the first section facing toward the front side of the second section, and the back side of the third section facing toward the back side of the fourth section.

2. The door of claim 1, wherein the first section adjoins the third section at a first transition, the second section adjoins the fourth section at a second transition, and the third section adjoins the fourth section at a third transition.

3. The door of claim 2, wherein the door panel defines a plane, the edge includes a first side surface and a second side surface, the first and second side surfaces on opposing sides of the plane, the first side surface facing away from the second side surface, the first transition being adjacent to the first side surface, the second transition being adjacent the second side surface, and the third transition being on the plane.

4. The door of claim 1, wherein the third section and the fourth section define a chamber therebetween, and the first section and the second section extend into the chamber.

5. The door of claim 1, wherein the sheet of material includes two distal edges between which the front side and the back side extend, the two distal edges delineating the first section and the second section, the two distal edges able to engage and reinforce the back side of the third section and the fourth section as a shape of the seal is changed by abutting and adjacent structure.

6. The door of claim 1, wherein the door panel extends along a plane, the edge includes a first side surface and a second side surface, the first and second side surfaces on opposing sides of the plane, the first side surface facing away from the second side surface, the seal being attached to the edge at a first area of attachment between the first side surface and the first section, and the seal being further attached to the edge at a second area of attachment between the second side surface and the second section.

7. The door of claim 6, wherein the sheet of material intersects the plane at an intersection, the first side surface of the edge being closer to the front side than the back side of the sheet of material and the edge being closer to the back side than to the front side at the intersection.

8. The door of claim 6, wherein the sheet of material intersects the plane at an intersection, the back side at the intersection faces the edge, and the front side at the first area of attachment and the front side at the second area of attachment faces toward the first side surface and the second side surface of the edge.

9. The door of claim 1, wherein the sheet of material is a seamless unitary piece.

10. The door of claim 9, further comprising a reinforcement layer of material attached to the back side of the sheet of material.

11. The door of claim 1, wherein the door panel is to be positioned between two areas of a room.

12. The door of claim 1, wherein the seal comprising the first, second, third and fourth sections provides a plurality of sealing surfaces lying tangentially along portions of the front side of the third and fourth sections.

13. The door of claim 1, further comprising:

a plurality of edges that includes the edge, the plurality of edges lying out of colinear alignment with each other; and a plurality of seals that includes the seal, the plurality of seals being attached to the plurality of edges.

14. The door of claim 13, wherein each seal from the plurality of seals is substantially similar in shape.

15. A door comprising:

a door panel having an edge member; and a seal attached to the edge member at a first area of attachment and a second area of attachment on the edge member, the seal comprising a sheet of material that is more flexible than the edge member;

a) the sheet of material comprising a first portion having a first radius of curvature, a second portion having a second radius of curvature, and a third portion having a third radius of curvature, the first portion, the second portion and the third portion of the sheet forming an arc to provide a first flexible bubble seal adjacent a first side of the door panel, a second flexible bubble seal adjacent a second side of the door panel, and a third flexible bubble seal adjacent a leading edge of the door panel, respectively, b) the first radius of curvature and the second radius of curvature being smaller than the third radius of curvature; and c) the edge member being closer to the first and second portions than to the third portion.

16. The door of claim 15, wherein the sheet of material and the edge member define a chamber therebetween, the sheet of material includes a first distal edge and a second distal edge disposed within the chamber.

17. The door of claim 16, wherein the first area of attachment is positioned between the first portion and the first distal edge.

18. The door of claim 16, wherein the sheet of material includes a first distal edge portion and a second distal edge portion, the first distal edge portion extending between the first area of attachment and the first distal edge, the second distal edge portion extending between the second area of attachment and the second distal edge, the first distal edge portion and the second distal edge portion being flatter than the first portion and the second portion.

19. The door of claim 16, wherein the first distal edge and the second distal edge able to engage and reinforce the third portion of the sheet of material as a shape of the seal is changed by abutting an adjacent structure.

20. The door of claim 15, wherein the sheet of material is a seamless unitary piece.

21. The door of claim 20, further comprising a reinforcement layer of material attached to the sheet of material.

22. The door of claim 15, wherein the door panel is between two areas of a room.

23. The door of claim 15, wherein the seal comprising the first, second and third portions is configured to form a plurality of seals against a corresponding plurality of surfaces lying tangentially along at least one of the first, second, or third portions.

24. The door of claim 15, further comprising:

a plurality of edge members that includes the edge member, the plurality of edge members lying out of colinear alignment with each other; and a plurality of seals that includes the seal, the plurality of seals attachable to the plurality of edge members.

25. The door of claim 24, wherein each seal of the plurality of seals has a substantially similar shape.

26. A door comprising:

a door panel disposed along a plane;

an edge member on the door panel, the edge member comprising a first side surface and a second side surface, the first and second side surfaces facing away from each other; and a seal attached to the edge member, the seal comprising a first internal sheet segment, a second internal sheet segment, a first external sheet segment and a second external sheet segment;

a) the first internal sheet segment, the second internal sheet segment, the first external sheet segment and the second external sheet segment being integral with each other to render the seal as a unitary sheet of material that is more flexible than the edge member;

b) the first internal sheet segment being connected to the first side surface of the edge member;

c) the second internal sheet segment being connected to the second side surface of the edge member;

d) the first and second internal sheet segments each being flatter than the first and second external sheet segments;

e) the first and second external sheet segments defining a chamber;

f the first and second internal sheet segments extending into the chamber; and g) the first and second internal sheet segments exerting a force substantially parallel to the plane, the force being transmitted to the first and second external sheet segments when the first and second external sheet segments move into engagement with the first and second internal sheet segments.

27. The door of claim 26, wherein the first internal sheet segment is between the first external sheet segment and the first side surface of the edge member, and the second internal sheet segment is between the second external sheet segment and the second side surface of the edge member.

28. The door of claim 26, further comprising a first transition between the first internal sheet segment and the first external sheet segment, a second transition between the second internal sheet segment and the second external sheet segment, a third transition between the first external sheet segment and the second external sheet segment, wherein the first transition is adjacent the first side surface, the second transition is adjacent the second side surface, and the third transition is on the plane.

29. The door of claim 26, wherein the door panel is between two areas of a room.

30. The door of claim 26, wherein the seal comprising the first and second external sheet segments provides a plurality of sealing surfaces lying tangentially along a plurality of planes.

31. The door of claim 26, further comprising:

a plurality of edge members that includes the edge member, the plurality of edge members lying out of colinear alignment with each other; and a plurality of seals that includes the seal, the plurality of seals to attach to the plurality of edge members.

32. The door apparatus of claim 31, wherein each seal of the plurality of seals has a substantially similar shape.

33. The door of claim 26, wherein the force is transmitted to the first and second external sheet segments when the first and second internal sheet segments engage the first and second external sheet segments as a shape of the seal is changed by abutting and an adjacent structure.

* * * * *

UNITED STATES PATENT AND TRADEMARK OFFICE

CERTIFICATE OF CORRECTION

PATENT NO. : 8,752,335 B2
APPLICATION NO. : 13/431601
DATED : June 17, 2014
INVENTOR(S) : David J. Hoffmann It is certified that error appears in the above-identified patent and that said Letters Patent is hereby corrected as shown below:

In the Claims

Column 8, line 9 (Claim 26): Enter a ")" after the letter "f"

Column 8, line 49 (Claim 33): Delete the word "and" between "abutting" and "an"

Signed and Sealed this
Twenty-third Day of September, 2014

Michelle K. Lee

Michelle K. Lee
*Deputy Director of the United States Patent and Trademark Office*